United States Patent [19]

Roman et al.

[11] Patent Number: 4,795,869

[45] Date of Patent: Jan. 3, 1989

[54] CONTACT ASSEMBLY FOR HIGH-VOLTAGE SWITCH

[75] Inventors: Christopher D. Roman, Glenview; Dean M. Czuma, Chicago, both of Ill.

[73] Assignee: S&C Electric Company, Chicago, Ill.

[21] Appl. No.: 92,026

[22] Filed: Sep. 1, 1987

[51] Int. Cl.[4] ..... H01H 1/50; H01H 9/00

[52] U.S. Cl. ..... 200/255; 200/48 KB; 200/260; 200/290

[58] Field of Search ..... 200/48 KB, 48 SB, 48 CB, 200/48 R, 255, 264, 271, 260, 290

[56] References Cited

U.S. PATENT DOCUMENTS

| | | | |
|---|---|---|---|
| 2,274,816 | 3/1942 | Winther, Jr. | 200/290 |
| 3,758,733 | 9/1973 | Durocher et al. | 200/264 |
| 4,101,747 | 7/1978 | Houk | 200/83 A |
| 4,296,284 | 10/1981 | Lott | 200/48 R |

FOREIGN PATENT DOCUMENTS

| | | | |
|---|---|---|---|
| 520401 | 6/1921 | France | 200/260 |
| 316521 | 11/1956 | Switzerland | 200/255 |

*Primary Examiner*—Renee S. Luebke

*Attorney, Agent, or Firm*—James V. Lapacek

[57] ABSTRACT

A contact assembly is provided for a high-voltage switch. The contact assembly includes one or more contact members that cooperate with a contact element. The arrangement of the contact members is such that an interference fit results with the contact element and one or more of the contact members are displaced. To provide operation of the contact assembly in ice-forming environments, facilities are provided to prevent the ingress of moisture and the formation of ice in the space required for displacement of the appropriate one or more contact members. Of course, if ice were allowed to occupy the space required for displacement of the one or more contact members, due to the relatively incompressible nature of ice, appropriate contact engagement would be inhibited since displacement of the one or more contact members would be unable to occur when engaged by the contact element. In a specific arrangement, the contact assembly includes a contact support structure which carries the contact members. A filler element is provided between the contact support structure and the contact members that are required to be displaceable. The filler element is deformable and/or compressible in response to the displacement of the contact member. Additionally, the filler element is impervious to the ingress of moisture or the formation of ice crystals and retains its flexiblity under ice-forming conditions.

8 Claims, 1 Drawing Sheet

CONTACT ASSEMBLY FOR HIGH-VOLTAGE SWITCH

BACKGROUND OF THE INVENTION

1. Field of the Invention

The present invention relates generally to structures having movable members which operate under ice-forming conditions, and more particularly to a contact assembly for a high-voltage switch.

2. Description of Related Art

Various arrangements are provided for high-voltage switches to prevent ice from forming on critical portions of contact structures; e.g., to avoid the accumulation of ice that might inhibit or prevent suitable cooperation of contacts.

A first type of ice-excluding design utilizes plate-like shields or hoods which are generally rigid and enclose or shield the contact assembly. The shield is arranged so as not to interfere with the operation of a movable contact with a contact assembly.

Another type of ice-excluding arrangement provides flexible shields which move out of the way when acted upon by the movable contact. For example, U.S. Pat. No. 4,296,284 discloses such an arrangement.

While these arrangements may be generally suitable for their intended purposes, neither of these two basic approaches prevents the ingress of moisture to critical portions of the contact structure. Additionally, the fixed shields are rather cumbersome and expensive and, under some environmental conditions, are not even totally effective in preventing precipitation from directly entering the contact structures. The flexible shields are also not totally effective under all circumstances and, additionally, complicate the operation of the switch; either by requiring appropriate mechanisms for moving the flexible shield out of the way during operation or by requiring that the moving contact engage the flexible shield. Further, the shields themselves are also subject to being bound up by ice or corrosion.

SUMMARY OF THE INVENTION

Accordingly, it is a principal object of the present invention to provide a contact assembly for a high-voltage switch which allows operation of the switching device in ice-forming environments without the use of either fixed or movable shields.

It is another object of the present invention to provide a contact assembly for a high-voltage switch of the type which utilizes one or more contact members that cooperate with a contact element; the contact assembly including provisions such that the displacement of one or more of the contact members in ice-forming environments is not inhibited or restricted.

Briefly, these and other objects of the present invention are efficiently achieved by the provision of a contact assembly for a high-voltage switch. The contact assembly includes one or more contact members that cooperate with a contact element. The arrangement of the contact members is such that an interference fit results with the contact element and one or more of the contact members are displaced. To provide operation of the contact assembly in ice-forming environments, facilities are provided to prevent the ingress of moisture and the formation of ice in the space required for displacement of the appropriate one or more contact members. Of course, if ice were allowed to occupy the space required for displacement of the one or more contact members, due to the relatively incompressible nature of ice, appropriate contact engagement would be inhibited since displacement of the one or more contact members would be unable to occur when engaged by the contact element. In a specific arrangement, the contact assembly includes a contact support structure which carries the contact members. A filler element is provided between the contact support structure and the contact members that are required to be displaceable. The filler element is deformable and/or compressible in response to the displacement of the contact member. Additionally, the filler element is impervious to the ingress of moisture or the formation of ice crystals and retains its flexibility under ice-forming conditions.

BRIEF DESCRIPTION OF THE DRAWING

The invention, as to both its organization and method of operation, together with further objects and advantages thereof, will best be understood by reference to the specification taken in conjunction with the accompanying drawing in which like reference characters refer to like elements and in which.

DETAILED DESCRIPTION

Figure 1:
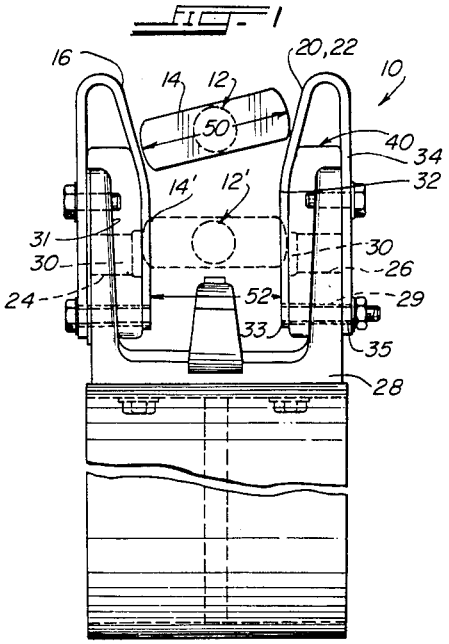
FIG. 1 is a front elevational view of the contact assembly of the present invention.
Figure 2:
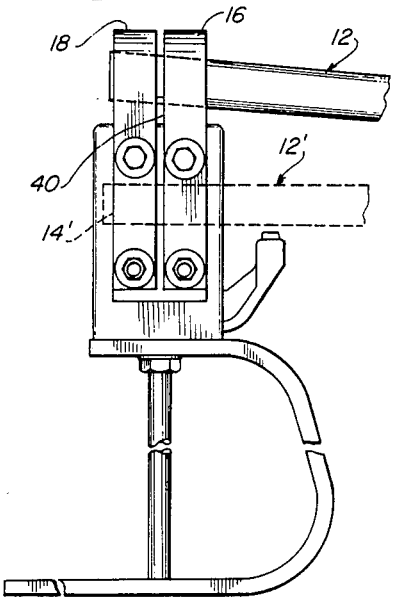
FIG. 2 is a left-side elevational view of the contact assembly of FIG. 1.

Referring now to FIGS. 1 and 2, the contact assembly 10 of the present invention is illustrated in conjunction with a movable contact arm 12, which is illustrated in a partially closed position. The movable contact arm 12 is also referred to as a disconnect blade in a high-voltage switch configuration. The movable contact arm 12 includess a movable contact element 14 which is arranged to cooperate with the contact members 16, 18, and 20 and a fourth contact member 22, not shown but located behind the contact member 20 in FIG. 1. The contact members 16, 18, 20, and 22 are resiliently mounted by springs 24,26 with respect to a contact support structure 28. A spacer element 30 is positioned between each of the springs 24,26 and the respective contact member. The contact members 16, 18, 20, and 22 are arranged in a pattern so as to define a gap of predetermined dimension 52 such that the contact members are displaced by the movable contact element 14 as it moves from the position shown in solid in FIGS. 1 and 2 to the fully closed position 12' shown in phantom in FIGS. 1 and 2; i.e., as the movable contact arm 12 and the movable contact element 14 are vertically lowered and slightly rotated. In response to the interference fit of the movable contact element 14 and the spaced contact members 16, 18, 20, and 22, the contact members 16, 18, 20, and 22 are displaced and a contact force or pressure results between the movable contact element 14 and the contact members 16, 18, 20, and 22.

The contact members 16, 18, 20, and 22 are generally U-shaped and include a first leg 32 that functions as a contact finger. The second leg 34 of the contact member is attached to the contact support 28 via fastener 36. The fastener 36 extends through both legs 32,34 of the contact members 16, 18, 20, and 22 and the contact support 28 via respective holes 33, 35, and 29.

In accordance with important aspects of the present invention, a filler element 40 is provided between the first leg 32 of each of the contact members 16, 18, 20, and 22 and the inner face 31 of the contact support 28. The filler element 40 provides a moisture and ice-excluding function by preventing the formation of ice in the area required for the displacement of the first leg 32 of each of the contact members 16, 18, 20, and 22. For example, without the provision of the filler element 40, various shields are required in an attempt to prevent moisture and ice from entering the space between the contact members 16, 18, 20, and 22 and the contact support structure 28; i.e., the volume through which the contact members 16, 18, 20, and 22 are displaced when the contact element 14 is moved to the fully closed position 14'. However, in addition to such shields not being fully effective, the provision of the filler element 40 renders such shields unnecessary. The filler elements 40 are deformable and/or compressible such that they do not interfere with the displacement of the contact members 16, 18, 20, and 22. Additionally, the filler elements 40 are fabricated such that they are impervious to moisture or ice. For example, in one specific embodiment, the filler elements 40 are fabricated in a mold as integrally skinned members of polyether polyurethane having an approximate pre-rise density of five pounds per cubic foot. Additionally, even though the material provides an integral skin that is impervious to moisture, it has been found beneficial to provide a surface coat of urethane lacquer to the filler elements 40. In other specific embodiments, the filler element 40 includes an outer periphery of integrally skinned composition with the internal portion either being hollow or filled with a suitable material such as foam which may be different than the integrally skinned polyether polyurethane.

Accordingly, even when the contact assembly 10 is exposed to ice-forming environments, since the filler elements 40 provide an ice-excluding function, the contact members 16, 18, 20, and 22 are capable of displacement by engagement with the contact element 14. The displacement of each of the contact members 16, 18, 20, and 22 is determined by the differences between the dimension 50 of the contact element 14 and the spacing 52 of the contact members 16, 18, 20, and 22.

Figure 3:
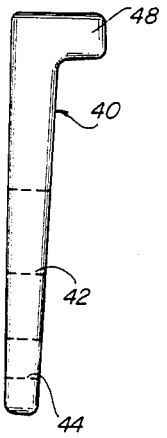
FIG. 3 is an elevational view of a filler element utilized in the contact assembly of FIGS. 1 and 2.
Figure 4:
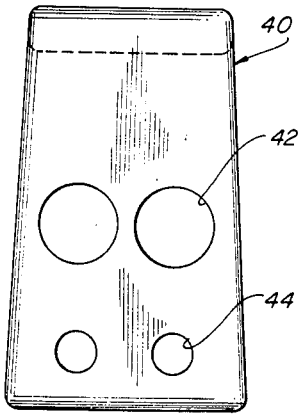
FIG. 4 is a left-side elevational view of the filler element of FIG. 3.

As can be seen in FIGS. 3 and 4, the filler elements 40 are molded into a convenient shape to generally conform to the volume between the contact members 16, 18, 20, and 22 and the support structure 28. A widened portion 48 is provided at the top of the filler element 40 to shield the interface of the filler element 40 and the inner face 31 of the contact support 28 from the ingress of moisture. Provision is also made for totally enclosing the springs 24,26 and the spacers 30 by means of holes 42. Additionally, holes 44 are provided for passage of the fasteners 36.

In a specific application, the contact assembly 10 as illustrated in FIGS. 1–4 is suitable for use with a high-voltage switch with disconnect blade, for example, of the types as shown in U.S. Pat. Nos. 3,769,477, 3,588,406, 4,112,268, and 4,481,387. However, it should be realized that the moisture and ice-excluding functions provided by the filler elements 40 of the present invention can be utilized for other contact assemblies including displaceable members or any other mechanism of varied environment which embodies movable members which are required to operate under ice-forming conditions.

While there has been illustrated and described various embodiments of the present invention, it will be apparent that various changes and modifications will occur to those skilled in the art. For example, while the spaced-apart contact members 16, 18, 20, and 22 are disclosed for illustrative purposes, in other specific embodiments, the contact members are arranged in various contact arrays or patterns with filler elements in various appropriate shapes being provided to allow the necessary displacement of one or more of the contact members for suitable contact engagement. Thus, in the illustrative specific embodiment of FIGS. 1 and 2, the contact members 16,18 do not necessarily require displacement if the contact members 20,22 are allowed appropriate displacement. Further, while the illustrative embodiment of FIGS. 1 and 2 depicts a movable contact 14 and a stationary contact structure carrying the contact members 16, 18, 20, and 22, it should be realized that in other specific embodiments, the contact members 16, 18, 20, and 22 are movable and the contact element 14 is either movable or stationary. Additionally, in other specific embodiments, a single self-supporting contact element is provided that defines one or more contact members. For example, the contact members 16,20 can be provided as a single self-supporting U-shaped element. It should also be realized that the present invention is applicable to other elements which require displacement space for operation whether on switches or other apparatus. It is intended in the appended claims to cover all such changes and modifications as fall within the true spirit and scope of the present invention.

What is claimed and desired to be secured by Letters Patent of the United States is:

1. A contact assembly comprising:

a first contact;

second contact means comprising at least two displaceable, spaced-apart contact members;

means for resiliently biasing said at least two contact members; and filling means for at least substantially filling the volume corresponding to that volume occupied during displacement of each of said at least two contact members in response to engagement by said first contact, said filling means being deformable and/or compressible, said filling means also being essentially impervious to moisture.

2. The contact assembly of claim 1 wherein said filling means is fabricated from polyether polyurethane.

3. The contact assembly of claim 1 further comprising contact support structure for supporting said at least two contact members, said filling means being fabricated to conform to at least a portion of said at least two contact members and at least a portion of said contact support structure.

4. The contact assembly of claim 1 further comprising contact support structure for supporting said at least two contact members, said filling means being disposed between said at least two contact members and said support structure.

5. The contact assembly of claim 4 wherein said filling means comprises a filler element for each of said at least two contact members, each of said at least two contact members having a first generally planar surface, said contact support structure including a second generally planar surface that faces said first generally planar surface of each of said at least two contact members, said filler element being generally planar and including surfaces that are fabricated to conform to said first and second generally planar surfaces, said filler element being disposed between said first and second generally planar surfaces.

6. A contact assembly comprising:

a first contact;

at least two displaceable spaced-apart contact members;

a contact support;

means for resiliently biasing said at least two contact members with respect to said contact support; and a filler element positioned between each of said at least two contact members and said contact support so as to permit displacement of said at least two contact members in response to engagement by said first contact, said filler element being fabricated so as to be compressible and essentially impervious to moisture, said filler elements at least substantially filling the volume defined by the displacement of said at least two contact members.

7. The contact assembly of claim 6 wherein said filler element encloses said resilient biasing means.

8. An arrangement for providing operation of spaced-apart movable switch members in ice-forming conditions in response to engagement by a contact member, said arrangement comprising deformable and/or compressible means for at least substantially occupying all the space which said movable switch members must occupy in response to engagement by the contact member, said deformable and/or compressible means being essentially impervious to ice.

* * * * *